US008666289B2

(12) United States Patent
Bucks et al.

(10) Patent No.: US 8,666,289 B2
(45) **Date of Patent: *Mar. 4, 2014**

(54) FEED AUGER WITH PADDLES

(75) Inventors: Rodney R. Bucks, Webster, NY (US); Jerry E. Livadas, Webster, NY (US); Eric C. Stelter, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 39 days.

This patent is subject to a terminal disclaimer.

(21) Appl. No.: 13/186,820

(22) Filed: Jul. 20, 2011

(65) Prior Publication Data

US 2013/0022372 A1 Jan. 24, 2013

(51) Int. Cl.
*G03G 15/08* (2006.01)

(52) U.S. Cl.
USPC ..... 399/254; 399/256

(58) Field of Classification Search
USPC ..... 399/254, 256; 366/318, 319, 322; 198/661
See application file for complete search history.

(56) References Cited

U.S. PATENT DOCUMENTS

| | | | | |
|---|---|---|---|---|
| 4,980,724 | A | 12/1990 | Tanaka | |
| 4,989,539 | A | 2/1991 | Ichikawa | |
| 5,249,019 | A | 9/1993 | Ishida et al. | |
| 5,572,297 | A | 11/1996 | Kawashima | |
| 5,842,090 | A | 11/1998 | Mikawa | |
| 6,099,159 | A | 8/2000 | Yoshida et al. | |
| 6,122,472 | A * | 9/2000 | Sako et al. | 399/254 |
| 6,266,504 | B1 | 7/2001 | Katoh | |
| 6,421,516 | B1 | 7/2002 | Kinoshita et al. | |
| 7,079,793 | B2 | 7/2006 | Amano et al. | |
| 7,212,772 | B2 | 5/2007 | Kasiske | |
| 7,313,348 | B2 | 12/2007 | Hart et al. | |
| 7,324,240 | B2 | 1/2008 | Ng | |
| 7,466,944 | B2 | 12/2008 | Bessho | |
| 7,468,820 | B2 | 12/2008 | Ng | |
| 7,634,215 | B2 | 12/2009 | Imamura et al. | |
| 7,647,009 | B2 | 1/2010 | Deguchi et al. | |
| 2004/0179865 | A1 * | 9/2004 | Nishiyama | 399/254 |
| 2007/0098450 | A1 * | 5/2007 | Hart et al. | 399/256 |
| 2007/0127951 | A1 * | 6/2007 | Ishikawa et al. | 399/254 |
| 2008/0050667 | A1 | 2/2008 | Lobo et al. | |
| 2008/0159786 | A1 | 7/2008 | Tombs et al. | |
| 2011/0311279 | A1 * | 12/2011 | Okazaki et al. | 399/254 |
| 2012/0100479 | A1 * | 4/2012 | Aslam et al. | 430/124.1 |

* cited by examiner

*Primary Examiner* — David Gray
*Assistant Examiner* — Thomas Giampaolo, II
(74) *Attorney, Agent, or Firm* — Nelson Adrian Blish

(57) ABSTRACT

A development system (10) for an electrophotographic printer with multiple augers containing a development roller (11) and a first channel contains a feed auger (13) and developer, with a plurality of paddles (12) attached to the feed auger, at least some the paddles increase in size with respect to a previous paddle along a direction of developer flow (18). This arrangement of paddles ensures that a uniform layer of developer is formed on the development roller despite the volume of developer in the first channel decreasing along the length of the first channel in the direction of developer flow.

13 Claims, 5 Drawing Sheets

FEED AUGER WITH PADDLES

CROSS REFERENCE TO RELATED APPLICATIONS

Reference is made to commonly-assigned U.S. patent application Ser. No. 13/186,829 (now U.S. Publication No. 2013/0022373), filed Jul. 20, 2011 herewith, entitled METHOD OF USING FEED AUGER WITH PADDLES, by Bucks et al.; the disclosure of which is incorporated herein.

FIELD OF THE INVENTION

The present invention relates to electrostatography, including electrography and electrophotography, and more particularly, to the design of a development system with multiple augers for an electrophotographic printer.

BACKGROUND OF THE INVENTION

The three channel development system used in electrophotographic printers has a development roller that moves developer containing toner into proximity with a primary imaging member, usually a photoconductor; and a first channel containing a feed auger, a second channel containing a second auger, a third channel containing at least a third auger, and possibly a fourth auger. The primary imaging member is used for forming an electrostatic image. The developer used in development systems of this type usually contains magnetic particles and marking particles. The marking particles are removed from the development system to form an image on the primary imaging member.

The flow of developer through the three channel development system is such that developer is fed from the third channel to a first end of the feed auger in the first channel. As the developer travels longitudinally down the length of the feed auger, a portion of the developer is fed transversely from the feed auger to the development roller to produce a layer of developer on the development roller. The remainder of developer in the first channel continues to travel longitudinally down the length of the feed auger.

To produce a uniform image, the layer of developer on the development roller should be uniform along its length. The developer that is fed to the development roller moves over the development roller and is not returned to the feed auger but instead drops into the second auger in the second channel. Consequently, the volume of developer in the first channel decreases along the length of the first channel in the direction of developer flow along the first channel.

Developer moves longitudinally in the same direction in both the first channel and the second channel, from the first end of the augers to the second end, which is at the rear or drive end of the development system. At the rear of the development system, the developer collected by the second channel and the remaining developer in the first channel are both dropped into the third channel. It is also at this point that replenishment marking particles are added to the developer to replace the marking particles that have been applied to the primary imaging member. The developer is moved longitudinally along the third channel by the third auger, or possibly by a third and forth auger acting together, toward the first end of the feed auger. The developer that has traveled the length of the third channel is fed to the first end of the feed auger in the first channel, so that the developer is cycled continuously from the first channel to the development roller, from the first and second channels to the third channel, and from the third channel to the first channel while the development system is running.

In comparison, two channel development system designs often have the characteristic that developer that has traveled over the development roller is dropped back into the channel from which it was fed to the development roller. Some of this developer will have had marking particles removed by the image. In other words, the concentration of marking particles in the developer is reduced as the developer is used for image development, returned to the feed auger, and subsequently travels down the feed auger of a two channel development system. As the toner concentration decreases, the developed mass and image density also decrease undesirably.

An advantage of the three channel design compared to a two channel design is that the marking particle concentration is maintained down the length of the first channel. However, the volume of developer in the first channel does not remain constant down its length, usually resulting in more developer on the development roller near the first end of the feed auger, where there is a relatively large volume of developer in the first channel. Near the second end of the feed auger, where there is a relatively small volume of developer, there is usually less developer on the development roller.

It is advantageous to have a constant mass flow of developer at any point along the entire length of the development roller as well as having a constant marking particle concentration in the developer that is presented to the primary imaging member via the development roller. Specifically, it is advantageous to have a means of maintaining the developer feed to the development roller despite the reduction in developer volume down the length of the first channel.

SUMMARY OF THE INVENTION

Briefly, according to one aspect of the present invention, a development system for an electrophotographic printer with multiple augers containing a development roller and a first channel contains a feed auger and developer, with a plurality of paddles attached to the feed auger, at least some of the paddles increase in size with respect to a previous paddle along a direction of developer flow. This arrangement of paddles ensures that a uniform layer of developer is formed on the development roller despite the volume of developer in the first channel decreasing along the length of the first channel in the direction of developer flow.

The invention and its objects and advantages will become more apparent in the detailed description of the preferred embodiment presented below.

DETAILED DESCRIPTION OF THE INVENTION

The present invention will be directed in particular to elements forming part of, or in cooperation more directly with the apparatus in accordance with the present invention. It is to be understood that elements not specifically shown or described may take various forms well known to those skilled in the art.

Figure 1:
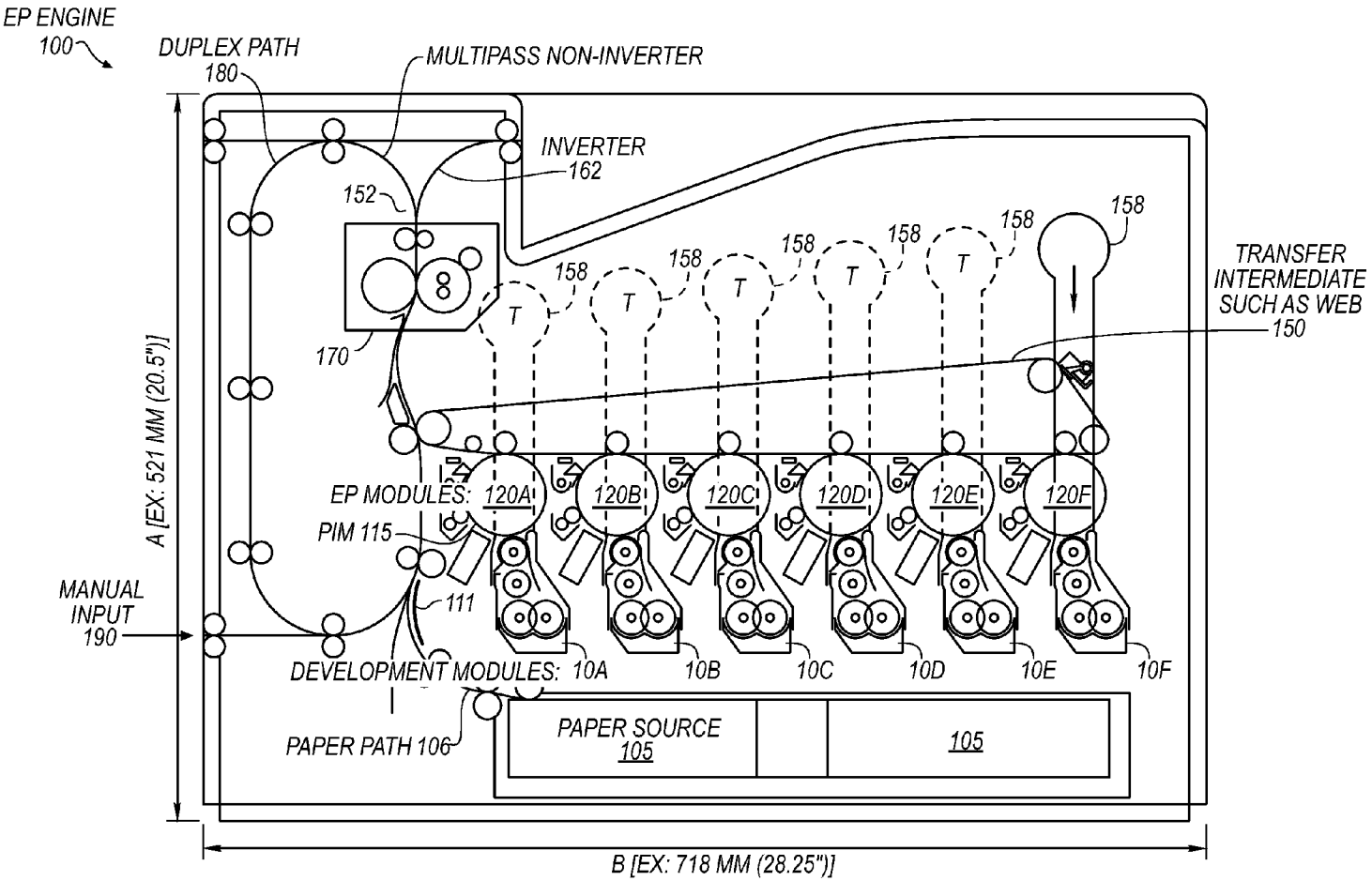
FIG. 1 is a cross-sectional view of an electrophotographic printer.

FIG. 1 shows an electrophotographic (EP) engine 100 or printer, often referred to as a tandem print engine including EP modules (120A, 120B, 120C, 120D, 120E, and 120F), wherein each contains a single primary imaging member 115 and a single development system (10A, 10B, 10C, 10D, 10E, and 10F) to print on receiver 111. The EP printer is shown having dimensions of A×B which are around in one example, 521×718 mm or less. Development stations 10A-10D would typically contain marking particles that are used in most color prints. For example, marking particles of the subtractive primary colors cyan, magenta, yellow, and black would be contained in four of these development stations, and have optical densities such that a monolayer coverage (i.e. sufficient application of marking particles such that a microscopic examination would reveal a layer of marking particles covering between 60% and 100% of a primary imaging member) would have a transmission density in the primarily absorbed light color, as measured using a device such as an X-Rite Densitometer with Status A filters of between 0.6 and 1.0). The additional development systems can be used to print specialty marking particles that are commonly used for many applications, selectively determined by a control element. An individual operating or owning (hereafter referred to as the operator) the EP engine could control the control element and this effectively determines which specialty marking particles would print.

For example, a full-color image can be made using marking particles that function as ink containing typical cyan, magenta, yellow, and black subtractive primary colorants such as pigment particles or dyes. The marking particles are contained in a development system that develops an electrostatic latent image and is in proximity to a cylindrical primary imaging member or a frame of a primary imaging member in the form of a continuous web. Additional marking particles corresponding to specialty toners or inks are contained in one of a plurality of development systems, any one of which can be brought into proximity with a primary imaging member bearing an electrostatic latent image and convert that electrostatic latent image into a visible image. For example, the electrophotographic engine shown in FIG. 1 contains six print modules. Four of the modules would each contain a single development system containing marking particles of one of the four subtractive primary colors. The fifth and sixth EP modules 120E and 120F are shown with development systems, each containing marking particles having the function of a distinct specialty ink that can convert an electrostatic latent image into a visible image with only that specific specialty ink.

For example, if clear toner is commonly used as a marking particle by a particular EP engine, the fifth development system 10E could contain clear toner. Alternatively, other marking particles that would be commonly used throughout a variety of jobs can be contained in the fifth EP module. The sixth EP module 120F is also capable of selectively printing a specialty marking particle. Images produced with specialty marking particles include transparent, raised print, MICR magnetic characters, specialty colors and metallic toners as well as other images that are not produced with the basic color marking particles.

Development systems suitable for use in this invention include dry development systems containing two component developers such as those containing both marking particles and magnetic carrier particles. The development systems used for two component development can have either a rotating magnetic core, a rotating shell around a fixed magnetic core, or a rotating magnetic core and a rotating magnetic shell. It is preferred that the marking particles used in practicing this invention are toner that is a component of dry developer. Marking particles are removed from the development system when images are printed. Replacement marking particles are added to the development systems 10A-10F by replenishment stations 158, each of which contains the appropriate marking particle.

In the example shown in FIG. 1, after each development system develops the electrostatic latent image on the primary imaging member (PIM) 115, thereby converting the electrostatic latent image a visible image, each image is transferred, in register, to an intermediate transfer member (ITM) 150. The ITM can be in the form of a continuous web as shown or can take other forms such as a drum or sheet. It is preferable to use a compliant intermediate transfer member, such as described in the literature, but noncompliant ITMs can also be used.

The receiver sheets are held in the printer at a paper tray (paper source) 105 and, in the example shown, enter the paper path 106 so as to travel initially in a counterclockwise direction. The paper could also be manually input 190 from the left side of the electrophotographic engine. The printed image is transferred from the ITM to the receiver and the image bearing receiver then passes through a fuser 170 where the image is permanently fixed to the receiver. The image then enters a region where the receiver either enters an inverter 162 or continues to travel counterclockwise. If the receiver enters the inverter, it travels clockwise, stops, and then travels counterclockwise back onto the duplex path 180. This inverts the image, thereby allowing the image to be duplexed. Prior to the inverter is a diverter 152 that can divert the receiver sheet from the inverter and sends it along the paper path in a counterclockwise direction. This allows multiple passes of the receiver on the simplex side, as might be desired if multiple layers of marking particles are used in the image or if special effects such as raised letter printing using large clear toner are to be used. Operation of the diverter to enable a repeat of simplex and duplex printing can be visualized using the duplex path 180 shown in FIG. 1.

It should be noted that, if desired, the fuser 170 can be disabled so as to allow a simplex image to pass through the fuser without fusing, if desired. This might be the case if an expanded color balance in simple printing is desired and a first fusing step might compromise color blending during the second pass through the EP engine. Alternatively, a fusing system that merely tacks, rather than fully fuses, an image and is known in the literature can be used if desired such as when multiple simplex images are to be produced. The image can also be sent through a subsystem that imparts a high gloss to the image, as is known in the literature and is described in co-owned U.S. Pat. Nos. 7,212,772; 7,324,240 and 7,468,820 as well as U.S. Publications 2008/159786 and 2008/0050667, which are hereby incorporated by reference.

Figure 2:
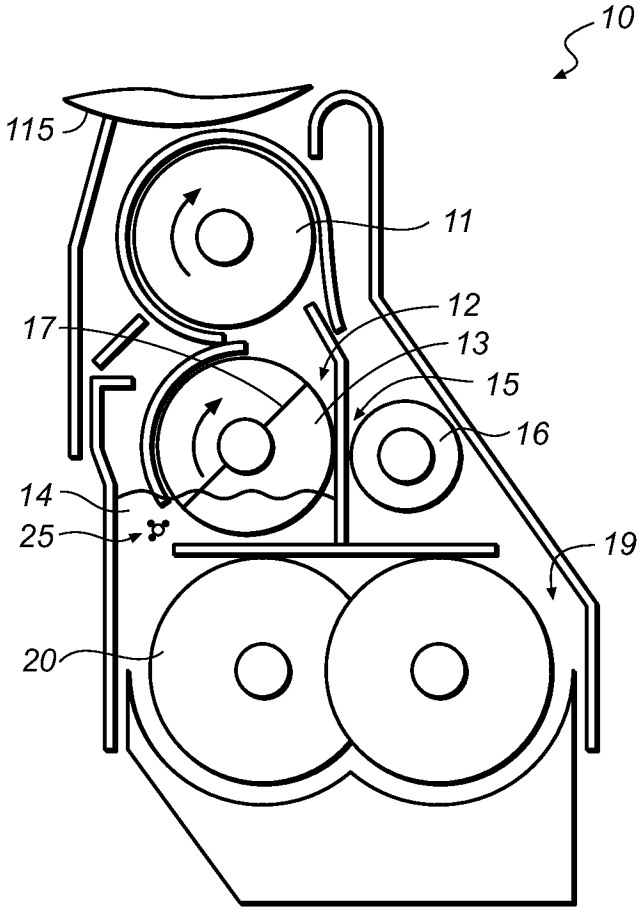
FIG. 2 is a transverse cross-sectional view of a development system for an electrophotographic printer according to an embodiment of the invention.
Figure 3:
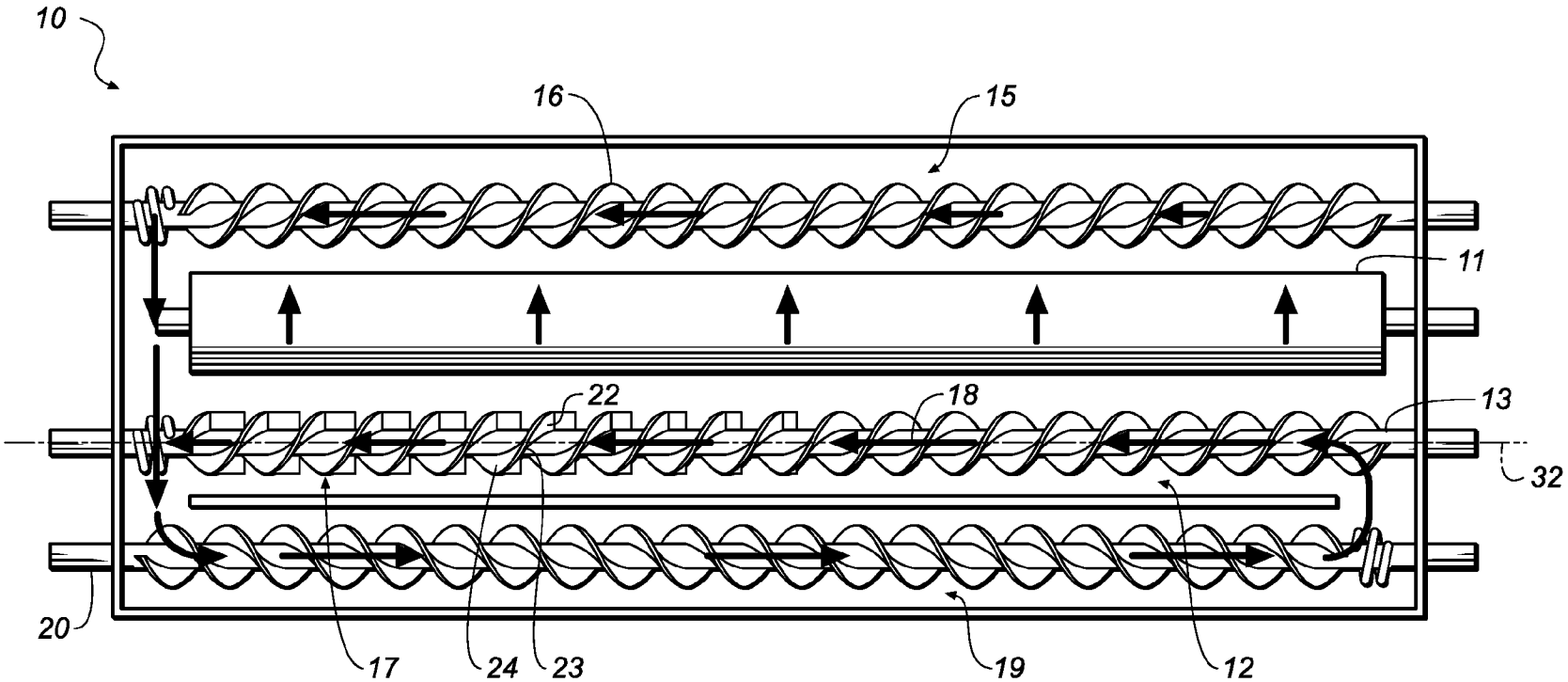
FIG. 3 is a longitudinal cross-sectional view of a development system for an electrophotographic printer according to an embodiment of the invention.

Referring now to FIG. 2 and FIG. 3, an arrangement of paddles are shown on the feed auger of development system 10 that assist the feed of developer to the development roller as the volume of developer in the first channel decreases, particularly where the volume of developer is small. FIG. 2 is a transverse cross-sectional view of a development system 10 for an electrophotographic printer according to an embodiment of the invention. A development roller 11 is adjacent a feed auger 13 in a first channel 12. The cross-sectional view of FIG. 2 shows a low volume of developer 14 containing magnetic particles and marking particles 25 (not to scale), with the marking particles represented schematically as a filled-in circle and the magnetic particles as an unfilled circle. Two of a plurality of paddles 17 on the feed auger are shown in the cross-section of feed auger 13. Developer is fed from the first channel 12 to the development roller 11, is moved to proximity with primary imaging member 115, and drops into second channel 15 with second auger 16. At the rear of the development system, the developer collected by the second channel 15 and the remaining developer in the first channel 12 are both dropped into the third channel 19, where at least a third auger 20 moves the developer to the front of the station, where it is fed to the first end of the feed auger 13 in the first channel 12.

FIG. 3 is a longitudinal cross-sectional schematic view of a development system for an electrophotographic printer according to an embodiment of the invention that shows a direction of developer flow 18 in the first channel 12 along an axis of the feed auger 32. The decreasing volume of developer in the first channel 12 is indicated by the decreasing length of the arrows 18 in the direction of developer flow. Uniform flow of developer over the development roller 11 is indicated by similar arrows of the same size. Increasing volume of developer in the second channel 15 is indicated by the increasing length of the arrows in the direction of developer flow. The arrows also indicate that developer from the first channel and the second channel is collected in the third channel 19, where it is mixed and fed to the first channel. In addition to a plurality of paddles 17 on the feed auger 13, FIG. 3 also shows paddles monotonically increasing in size to compensate for the decrease of volume of developer along the axis 32 of feed auger 13. For the direction of developer flow 18 indicated in FIG. 3, inspection shows that the feed auger 13 must turn in such a way that the lower half of the auger rotates toward the observer and the upper half rotates away. The side of an auger flight 23 that pushes the developer in the direction of developer flow 18 is denoted as a working face of an auger 24. The other side of the flight, which does not push the developer when the auger is rotated in the preferred direction of rotation, is denoted as a trailing face of an auger 22. The direction of developer flow is always from the working face of an auger to the trailing face of an auger. Consequently, it is preferred that the plurality of paddles 17 are attached to the trailing face of an auger 22 so as to feed developer toward development roller 11 without impeding the travel of developer in the direction of developer flow 18. Although the feed auger 13 in FIG. 3 is a left handed auger with a direction of developer flow 18 from right to left, the invention can be used with left or right handed augers with any direction of developer flow (left to right or right to left) as long as the plurality of paddles 17 are attached to the trailing face 22 of an auger.

Figure 4A:
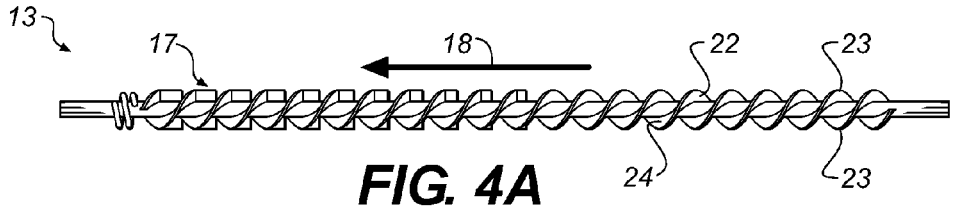
FIG. 4A is a perspective view of feed augers according to embodiments of the invention.
Figure 4B:
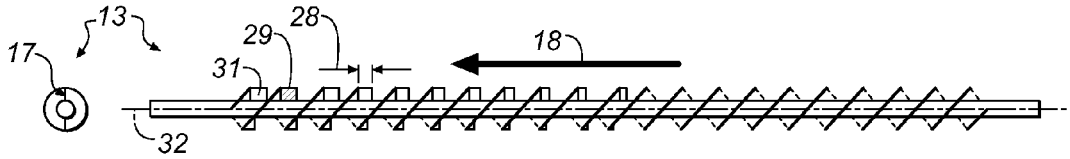
FIGS. 4B-4E are schematic views of feed augers according to embodiments of the invention.

Referring now to FIG. 4A and FIG. 4B, an arrangement of paddles are shown on the feed auger 13 that assist the feed of developer to the development roller as the developer volume decreases from the first end of the auger to the second end of the auger. FIG. 4A is a perspective view of a feed auger 13 and FIG. 4B is a schematic view of the same feed auger shown in FIG. 4A in longitudinal cross-section and in transverse cross-section. Each auger flight 23 forms a helix. There are two auger flights on feed auger 13. As the auger rotates to move developer from the first end to the second end in a direction of developer flow 18, the developer is moved by a working face 24 of the auger flights. Paddles are placed on the trailing face 22 of the auger flights to throw developer toward the development roller. These paddles are added from the midpoint of the auger on and increase in size down the length of the feed auger. As the volume of developer decreases in the first channel, the paddles assist in the transport of developer to the development roller. Where the volume of developer in the first channel is larger, the magnetic field of the toning roller can pick up sufficient developer from the feed auger. The addition of the plurality of paddles 17 to the feed auger 13 moves developer toward the development roller and allows sufficient developer to be picked up by the development roller. If the paddles were not present, the magnetic field would not be strong enough to pick up sufficient developer, as the magnetic field strength is too low at the height of the reduced volume of developer. A surface of a paddle 31 is responsible for moving the developer away from the axis of the feed auger 32 and toward the developer roller. The area of the paddles 29 increases in the direction of flow of developer 18.

Figure 4C:
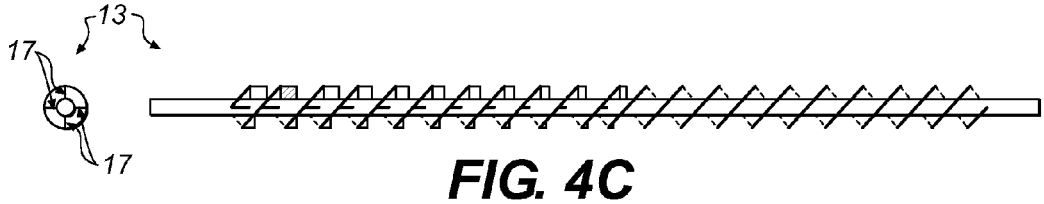
Figure 4D:
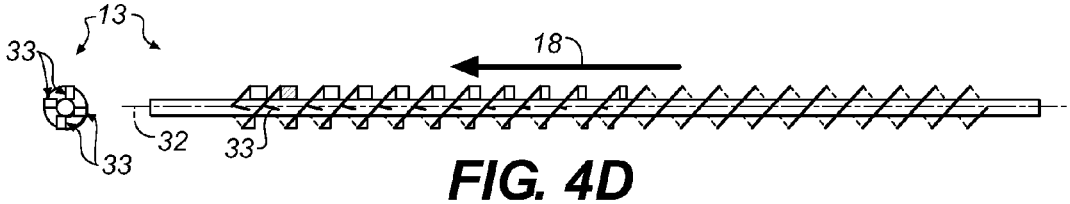
Figure 4E:
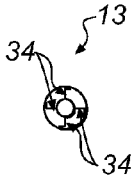

In the preferred embodiment, the length of the paddles 28 increases along the axis of the feed auger 32 in the direction of flow of developer 18 to compensate for the decreasing amount of developer along the axis of the feed auger. In accordance with the invention, at least some of the paddles increase in size with respect to a previous paddle along a direction of developer flow. According to another aspect of the invention, the paddles monotonically increase in size. This can be accomplished by a length of the paddles increasing in an axial direction of flow or by an area of the paddles increasing in a direction of flow. In FIGS. 4A-4E (where FIG. 4E only shows a cross-section of an embodiment of feed auger 13) a pitch of the feed auger is constant. FIGS. 4A and 4B have one paddle per pitch of the auger 13 on each auger flight in the region in which the paddles are required. FIGS. 4C, 4D, and 4E have two paddles per pitch of the auger 13 on each auger flight. In the region where the paddles are required, at least one paddle per auger pitch is used. Several forms of paddle can be used to enhance the movement of developer from the first channel to the development roller. FIG. 4D shows paddles 33 at an acute angle to the axis of the feed auger 32. Specifically, a normal to a surface of at least one paddle is at an acute angle to an axis of the feed auger. For this configuration, the acute angle of the paddles moves developer away from feed auger 13 and against the direction of developer flow 18. FIG. 4E shows concave paddles 34 that act as buckets to move more developer toward the development roller.

Figure 5:
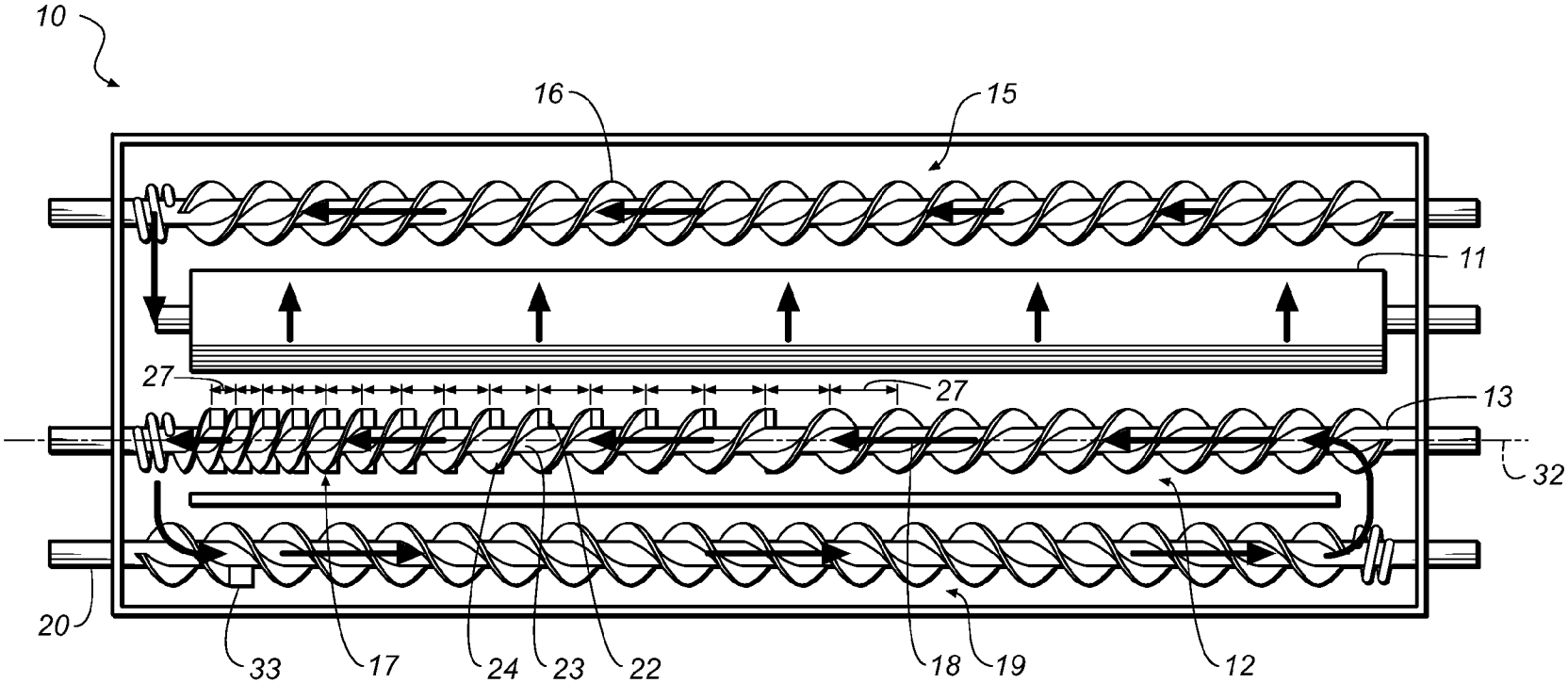
FIG. 5 is a longitudinal cross-sectional view of a development system for an electrophotographic printer according to an embodiment of the invention.

Referring now to FIG. 5, which is a longitudinal cross-sectional view of a development system for an electrophotographic printer according to an embodiment of the invention, a pitch of the feed auger 27 decreases in the direction of flow 18. This decreases the motion of developer in the direction of developer flow, and allows the plurality of paddles 17 to be more effective. The development system shown in FIG. 5 also has at least one paddle attached to a working face of at least one auger flight, and particularly, a paddle 33 is attached to the third auger 20 to increase mixing of developer after the replenishment marking particles have been added to the third chamber 19. This additional mixing provides for a more uniform marking particle concentration in the developer that is delivered to the feed auger.

The invention has been described in detail with particular reference to certain preferred embodiments thereof, but it will be understood that variations and modifications can be effected within the scope of the invention.

PARTS LIST

10 development system
10A-10F development system

11 development roller
12 first channel
13 feed auger
14 developer
15 second channel
16 second auger
17 plurality of paddles
18 direction of developer flow
19 third channel
20 third auger
22 trailing face of auger
23 auger flight
24 working face an auger
25 magnetic particles and marking particles
27 pitch of the feed auger decreases in the direction of flow
28 length of the paddles
29 area of the paddles
31 surface of a paddle
32 axis of the feed auger
33 paddle at acute angle to an axis of the feed auger
34 concave paddles
100 electrophotographic (EP) engine or printer
105 paper source
111 receiver
106 paper path
115 primary imaging member (PIM)
120A-120F electrophotographic (EP) module
150 intermediate transfer member (ITM)
152 diverter
158 replenishment station
162 inverter
170 fuser
180 duplex path
190 manual input

The invention claimed is:

1. A development system for an electrophotographic printer with multiple augers comprising:
a development roller;
a first channel containing a feed auger and developer;
a second channel containing a second auger;
wherein developer from the first channel is fed to the development roller and transported across at least a portion of the development roller;
wherein developer from the development roller is released to the second channel;
a plurality of paddles attached to the feed auger; and
wherein, from the midpoint of the feed auger, the paddles increase in size with respect to a previous paddle along a direction of developer flow.

2. The development system of claim 1 wherein the paddles monotonically increase in size.

3. The development system of claim 1 wherein at least one paddle is attached to a trailing face of at least one auger flight.

4. The development system of claim 1 wherein the developer comprises magnetic particles and marking particles.

5. The development system of claim 1 wherein a pitch the feed auger is constant.

6. The development system of claim 1 wherein a length of the paddles increases in an axial direction of flow.

7. The development system of claim 1 wherein an area of the paddles increases in an direction of flow.

8. The development system of claim 1 wherein a normal to a surface of at least one paddles is perpendicular to an axis of the feed auger.

9. The development system of claim 1 wherein replenishment toner is added to the second channel.

10. A development system for an electrophotographic printer with multiple augers comprising:
a development roller;
a first channel containing a feed auger and developer;
a second channel containing a second auger;
a third channel containing a third auger;
wherein developer from the first channel is fed to the development roller transported across at least a portion of the development roller;
wherein developer from the development roller is released to the second channel;
wherein developer from the second channel is released to the third channel;
a plurality of paddles attached to the feed auger; and wherein, from the midpoint of the feed auger, the paddles increase in size with respect to a previous paddle along a direction of developer flow.

11. A development system for an electrophotographic printer with multiple augers comprising:
a development roller;
a first channel containing a feed auger and developer;
a second channel containing a second auger;
wherein developer from the first channel is fed to the development roller and transported across at least a portion of the development roller;
wherein developer from the development roller is released to the second channel;
a plurality of paddles attached to the feed auger;
wherein, from the midpoint of the feed auger, the paddles increase in size with respect to a previous paddle along a direction of developer flow; and
wherein a pitch of the feed auger decreases in the direction of flow.

12. A development system for an electrophotographic printer with multiple augers comprising:
a development roller;
a first channel containing a feed auger and developer;
a second channel containing a second auger;
wherein developer from the first channel is fed to the development roller and transported across at least a portion of the development roller;
wherein developer from the development roller is released to the second channel;
a plurality of paddles attached to the feed auger;
wherein, from the midpoint of the feed auger, the paddles increase in size with respect to a previous paddle along a direction of developer flow; and
wherein a normal to a surface of at least one paddles is at an acute angle to an axis of the feed auger.

13. A development system for an electrophotographic printer with multiple augers comprising:
a development roller;
a first channel containing a feed auger and developer;
a second channel containing a second auger;
wherein developer from the first channel is fed to the development roller and transported across at least a portion of the development roller;
wherein developer from the development roller is released to the second channel;
a plurality of paddles attached to the feed auger;
wherein, from the midpoint of the feed auger, the paddles increase in size with respect to a previous paddle along a direction of developer flow; and
wherein a surface of at least one of the paddles is concave.

* * * * *